US010519572B2

(12) United States Patent
Yang et al.

(10) Patent No.: US 10,519,572 B2
(45) Date of Patent: Dec. 31, 2019

(54) CARPET YARN TWISTING MACHINE

(71) Applicant: YICHANG JINGWEI TEXTILE MACHINERY CO., LTD., Yichang, Hubei (CN)

(72) Inventors: Huaming Yang, Hubei (CN); Ming Zhang, Hubei (CN); Jinjia Xu, Hubei (CN); Bin Wang, Hubei (CN); Huanian Yang, Hubei (CN); Yae Liu, Hubei (CN); Wentao Chen, Hubei (CN); Guoxing Lu, Hubei (CN); Haibo Jiang, Hubei (CN); Huanjun Zhang, Hubei (CN); Hu Song, Hubei (CN); Qi Li, Hubei (CN)

(73) Assignee: YICHANG JINGWEI TEXTILE MACHINERY CO., LTD. (CN)

( * ) Notice: Subject to any disclaimer, the term of this patent is extended or adjusted under 35 U.S.C. 154(b) by 142 days.

(21) Appl. No.: 15/728,503

(22) Filed: Oct. 10, 2017

(65) Prior Publication Data

US 2019/0010632 A1 Jan. 10, 2019

(30) Foreign Application Priority Data

Jul. 7, 2017 (CN) ..... 2017 1 0548484

(51) Int. Cl.
*D01H 1/10* (2006.01)
*D01H 1/02* (2006.01)
(Continued)

(52) U.S. Cl.
CPC ..... *D01H 1/106* (2013.01); *D01H 1/02* (2013.01); *D01H 13/02* (2013.01); *D01H 13/10* (2013.01)

(58) Field of Classification Search
CPC ..... D01H 1/106; D01H 1/105; D01H 1/02; D01H 1/10; D01H 1/101; D01H 1/108;
(Continued)

(56) References Cited

U.S. PATENT DOCUMENTS 2,788,632 A * 4/1957 Dewhirst ..... D01H 13/10 57/68
2,871,648 A * 2/1959 Vibber ..... D01H 13/108 57/58.36
(Continued)

FOREIGN PATENT DOCUMENTS

CN 201172717 * 12/2008 ..... D01H 7/04
WO WO-2012167737 A1 * 12/2012 ..... D01H 13/10

OTHER PUBLICATIONS

English translation of description of CN201172717 obtained via Espacenet.com on Apr. 16, 2019.*
(Continued)

*Primary Examiner* — Shaun R Hurley
*Assistant Examiner* — Patrick J. Lynch

(57) ABSTRACT

The disclosure describes a yarn twisting machine in which a hollow spindle rod is fixedly connected with a motor that drives the hollow spindle rod to rotate, a twisting disc and a yarn storage disc are fixedly connected with the hollow spindle rod and rotate along with the hollow spindle rod, the yarn storage disc is provided with yarn outlets, which communicate with inner yarn channels of the hollow spindle rod spindle tanks for accommodating inner yarn packages are connected with the hollow spindle rod through spindle rod bearings, and the spindle tanks are immobile.

7 Claims, 15 Drawing Sheets

(51) Int. Cl.
*D01H 13/02* (2006.01)
*D01H 13/10* (2006.01)

(58) Field of Classification Search
CPC ..... D01H 1/166; D01H 1/18; D01H 1/183; D01H 7/88; D01H 7/04; D01H 7/86; D01H 7/08; D01H 13/02; D01H 13/10; D01H 15/007
USPC ..... 57/58.49, 58.52
See application file for complete search history.

(56) References Cited

U.S. PATENT DOCUMENTS 3,360,915 A * 1/1968 Franzen ..... D01H 9/006 57/266
3,373,551 A * 3/1968 Gillono ..... D01H 1/183 57/262
3,776,480 A * 12/1973 Lawson ..... B65H 51/22 242/364.7
4,928,475 A * 5/1990 Matsui ..... B65H 54/26 242/473.5
5,329,756 A * 7/1994 Meroni ..... D01H 13/005 57/22
6,035,620 A * 3/2000 Kallmann ..... D01H 7/86 57/354
6,311,468 B1 * 11/2001 Beckmann ..... D01H 4/30 57/409
7,051,507 B2 * 5/2006 Fritsch ..... D02G 3/28 57/314
7,513,021 B1 * 4/2009 Haselwander ..... D01H 7/86 28/247
8,033,089 B2 * 10/2011 Leupers ..... D02G 3/285 57/58.52
2003/0110753 A1 * 6/2003 Galan Pujol ..... D01H 1/106 57/58.49
2010/0018178 A1 * 1/2010 Fink ..... D01H 7/88 57/279
2014/0202129 A1 * 7/2014 Hoover ..... D01H 1/10 57/58.86
2017/0130369 A1 * 5/2017 Raisich ..... D01H 1/103

OTHER PUBLICATIONS

English translation of description of WO2012167737 obtained via WIPO (https://patentscope.wipo.int/search/en/search.jsf) on Apr. 16, 2019.*

* cited by examiner

CARPET YARN TWISTING MACHINE

FIELD

The present invention relates to the field of textile machinery, in particular to a carpet twisting machine.

BACKGROUND

Spindles of the known Bulked Continuous Filament ("BCF") twisting machine adopt the spindle belt transmission mode, which means that a main motor in a machine head box drives a spindle transmission shaft, and the spindle transmission shaft drives spindles to rotate through a spindle belt. The spindle speed is changed through changing of belt pulleys. The spindle belt transmission mode is disadvantaged in complicated operation of change of the spindle speed, large workload, large difference in spindle speed between different spindles, and difficulties in cleaning of space below the spindles caused by occupation. For example, CN1473077A discloses a two-in-one spindle. For another example, CN102212903 A discloses a two-in-one spindle or a twisting spindle. For the spindle-belt transmission mode, the revolving speed of the spindle rod is usually 3,000-6,000 rpm, and the twisting efficiency is relatively low.

The known BCF twisting machine adopts an overfeeding mode that a yarn clamping disc pulls up twisted yarns and conveys the yarns to reeling rollers. A motor in a machine head box respectively drives an overfeeding shaft and a reeling shaft by changing the gear transmission ratio and adjusting the ratio of the revolving speed of the overfeeding shaft over the revolving speed of the reeling shaft. Another method for changing the overfeeding ratio is to change the wrap angle of the yarns on the yarn clamping disc. Changing the overfeeding ratio of the overfeeding structure through the yarn clamping disc must be carried in the halt mode, and the method of changing the gear transmission ratio and the method of changing the wrap angle of the yarns on the yarn clamping disc are both relatively complicated, massively labored and time-consuming.

The existing tension adjusters are usually complicated in structure. Common tension adjusters include hysteresis tensioner and electromagnetic tensioner. For example, Cao Xia stated that changing excitation could generate a relatively large effect on the torque in the Electromagnetic Yarn Tensioner Principle and Dynamic Property Testing and Analysis. However, affected by the number of the magnetic poles, the torque is fluctuating on the circumference. Such fluctuation has bigger effects when the revolving speed is lower.

SUMMARY

The technical problem to be solved by the present invention is to provide a carpet yarn twisting machine, which can improve the twisting efficiency. In an optimized solution, the machine can apply to direct twisting/two-in-one twisting, ensure the reeling uniformity of the twisted yarns, control ballooning form to reduce energy consumption, and optimize the linearity of the tension control.

In order to solve the above technical problems, the present invention adopts the following technical solution: A carpet yarn twisting machine includes a machine frame, a creel unit, an electric spindle unit, an overfeeding unit and a reeling unit. In the electric spindle unit, a hollow spindle rod is fixedly connected with a motor; the motor drives the hollow spindle rod to rotate, and a twisting disc and a yarn storage disc are fixedly connected with the hollow spindle rod and rotate along with the hollow spindle rod.

The yarn storage disc is provided with yarn outlets which communicate with inner yarn channels of the hollow spindle rod.

Spindle tanks for accommodating inner yarn packages are connected with the hollow spindle rod through spindle rod bearings, and the spindle tanks are immobile.

In an optimized solution, the hollow spindle rod is provided with a step shaft at the top; at least two spindle rod bearings are sleeved on the step shaft; bearing base are respectively sleeved on respective spindle rod bearings; and lower spindle tanks of the spindle tanks are sleeved with the bearing bases;

wherein spindle tank inner rods, which are fixedly connected with the lower spindle tanks and are capable being replaced, are also provided;

wherein each one of the spindle tank inner rods includes a two-for-one twisting inner spindle rod for two-in-one twisting; the bottom of the two-for-one twisting inner spindle rod is sleeved with each corresponding one of the lower spindle tanks; the top of the two-for-one twisting inner spindle rod is provided with a two-for-one twisting spindle wing, the two-for-one twisting spindle wing is a suspending arm structure; the suspending arm is provided with a ceramic ring through which internal yarns pass at the free end; the two-for-one twisting inner spindle rod is formed with an axial through-hole in the middle; the through-hole communicates with the yarn channels with upward tails in a vertical direction in a yarn guide base component;

wherein a shaft is disposed in the center of the through-hole of the two-for-one twisting inner spindle rod; an upper steel lining and a lower steel lining are also disposed in the through-hole; the upper steel lining and the lower steel lining are penetrated on the shaft in the center of the through-hole;

or, a steel ball type two-in-one tensioner is disposed in the through-hole of the two-in-one twisting inner spindle rod, wherein the structure of the steel ball type two-in-one tensioner is that: the two-in-one twisting inner spindle rod is internally provided with a sliding inner spindle rod, the sliding inner spindle rod is sleeved with an inner spindle rod base in a sealing and sliding way, an inner spindle rod spring is disposed between the inner spindle rod base and the sliding inner spindle rod, the sliding inner spindle rod is provided with a spindle rod ceramic ring base at the top, the spindle rod ceramic ring base has a swelling cavity inside, a ceramic ring with a tapered upper opening is disposed at the bottom of the cavity, and the spindle rod ceramic ring base is internally provided with a steel ball.

In an optimized solution, a twisting package conveyor is disposed below the reeling unit; the twisting package conveyor is a belt conveyor which penetrates through the whole twisting station; the twisting package conveyor is provided with a twisting package unloading unit at the tail, and the twisting package unloading unit is provided with an inclined slideway at the top.

In an optimized solution, a liftable yarn guide unit is disposed at the top of each one of the spindle tanks; the yarn guide unit is internally provided with a suspending arm structure; the base of the suspending arm structure vertically slides along the machine frame; a ceramic ring through which yarns pass is disposed at the free end of the suspending arm structure; the axis of the ceramic ring is superimposed with the axis of the hollow spindle rod; and a mechanism for driving the yarn guide unit to move up and down includes a belt mechanism and a screw-and-nut mechanism or a pinion-and-rack mechanism.

In an optimized solution, in the overfeeding unit, driving overfeeding rollers and driven overfeeding rollers are arranged an interval;

the driven overfeeding rollers are inclined with respect to the axes of the driving overfeeding rollers;

the driving overfeeding rollers are connected with a driving unit through a transmission mechanism;

and the linear speed of the surfaces of the driving overfeeding rollers is higher than that of the surfaces of reeling rollers in the reeling unit.

In the optimized solution, in each one of the driving overfeeding rollers, a driving gear is in an engaged connection with a driven gear, while the driven gear is connected with a shaft through a bearing; the shaft is fixedly connected with a roller body; the shaft is connected with a bracket through the bearing; a clutch disc is installed on the shaft in an axial sliding way, the clutch disc is capable of driving the shaft to rotate; an end face of the clutch disc and an end face of the driven gear are in a separable transmission connection; the shaft is provided with a spring for compressing the clutch disc toward the driven gear and is also fixedly provided with an electromagnetic clutch; and the electromagnetic clutch is internally provided with a coil for absorbing the clutch disc, overcoming the spring force of the spring and separating the clutch from the driven gear.

In the optimized solution, in the reeling unit, a reeling bracket is a quadrilateral mechanism capable of swinging up and down; the reeling bracket is used for installing twisting packages; a reeling roller driven to rotate by a driven unit is disposed below each one of the twisting packages; the outer walls of the reeling rollers contact the outer walls of the twisting packages; and a transverse yarn guide is disposed in the yarn coming direction of the reeling rollers.

Each one of the reeling rollers is internally provided with a clutch device with a specific structure that: a reeling roller inner barrel is fixedly connected with a transmission shaft, a middle transmission member is supported on the reeling roller inner barrel through two transmission roller bearings, a reeling roller outer barrel is fixedly connected with the middle transmission member, a friction disc is disposed on one side of the middle transmission member, the friction disc and the reeling roller outer barrel are connected in a way of being capable of moving with respect each other along the axial direction and being incapable of rotating with respect to each other, the friction disc is made of ferromagnet, the middle transmission member is internally provided with a reeling roller electromagnetic coil, the reeling roller inner barrel is provided with a convex ring on the other side of the friction disc, the ring is provided with a friction sheet which is matched with the friction disc to from frictional transmission, and a spring is disposed between the middle transmission member and the friction disc.

In an optimized solution, a tension compensating rod is disposed between the overfeeding unit and the reeling unit; one end of the tension compensating rod is hinged with the machine frame while the other end is provided with a yarn wheel; twisted yarns going out of the overfeeding unit are reeled on the yarn wheel and then enter the reeling unit via the transverse yarn guide such that the tension compensating rod swings to be close to vertical and horizontal alternatively according to the tension.

In an optimized solution, a tension unit is also provided;

wherein the tension unit is disposed on the creel unit, the tension unit includes driven tension rollers and driving tension rollers of which the outer walls contact one another, the driven tension rollers are fixedly installed, the driving tension rollers are connected with tension air cylinders through fork-shaped tension brackets, the tension air cylinders communicate with air pipes, and each one of the air pipes is provided with an electromagnetic proportioning valve and an air pressure sensor;

or wherein the tension unit is disposed on the machine frame, a tension roller or a yarn guide wheel is fixedly connected with one end of a tension rod; the tension rod is supported on a fixed tension rod bearing; the other end of the tension rod extends into a sealed housing; the portion, in the sealed housing, of the tension rod is provided tension rod blades; the sealed housing is internally filled in with damping medium; the tension rod and the sealed housing are in a sliding connection; a tension motor and a nut sleeve are in a fixed connection; the nut and the sealed housing are in a threaded connection; by rotating the nut, the axial position of the sealed housing is capable of being adjusted, and the depth of the tension rod blades in the damping medium is capable of being adjusted.

The present invention provides a carpet yarn twisting machine. By adopting the solution that the motor directly drives the spindle to replace the solution of spindle belt transmission in the prior art, the spindle obtains a higher revolving speed that is increased from the existing 4,000-6,000 rpm to 7,000-10,000 rpm, improving the twisting efficiency of the carpet yarns. By adopting the driving overfeeding rollers with the electromagnetic clutches and cooperating with the tension compensating rod and the reeling unit, the overfeeding unit can ensure the reeling uniformity of the twisting packages, and can switch off the electromagnetic clutches according to the signals sent by a broken yarn detector to stop the equipment. The tension unit adopts the structure of pneumatic tension rollers and can conveniently realize automatic control over the tension. Or, the tension unit adopts a liquid damping tension adjusting structure and can realize linear adjustment on the tension changes without fluctuation during the tension adjusting process.

BRIEF DESCRIPTION OF THE DRAWINGS

The present invention is further described in conjunction with attached drawings and embodiments.

Figure 1:
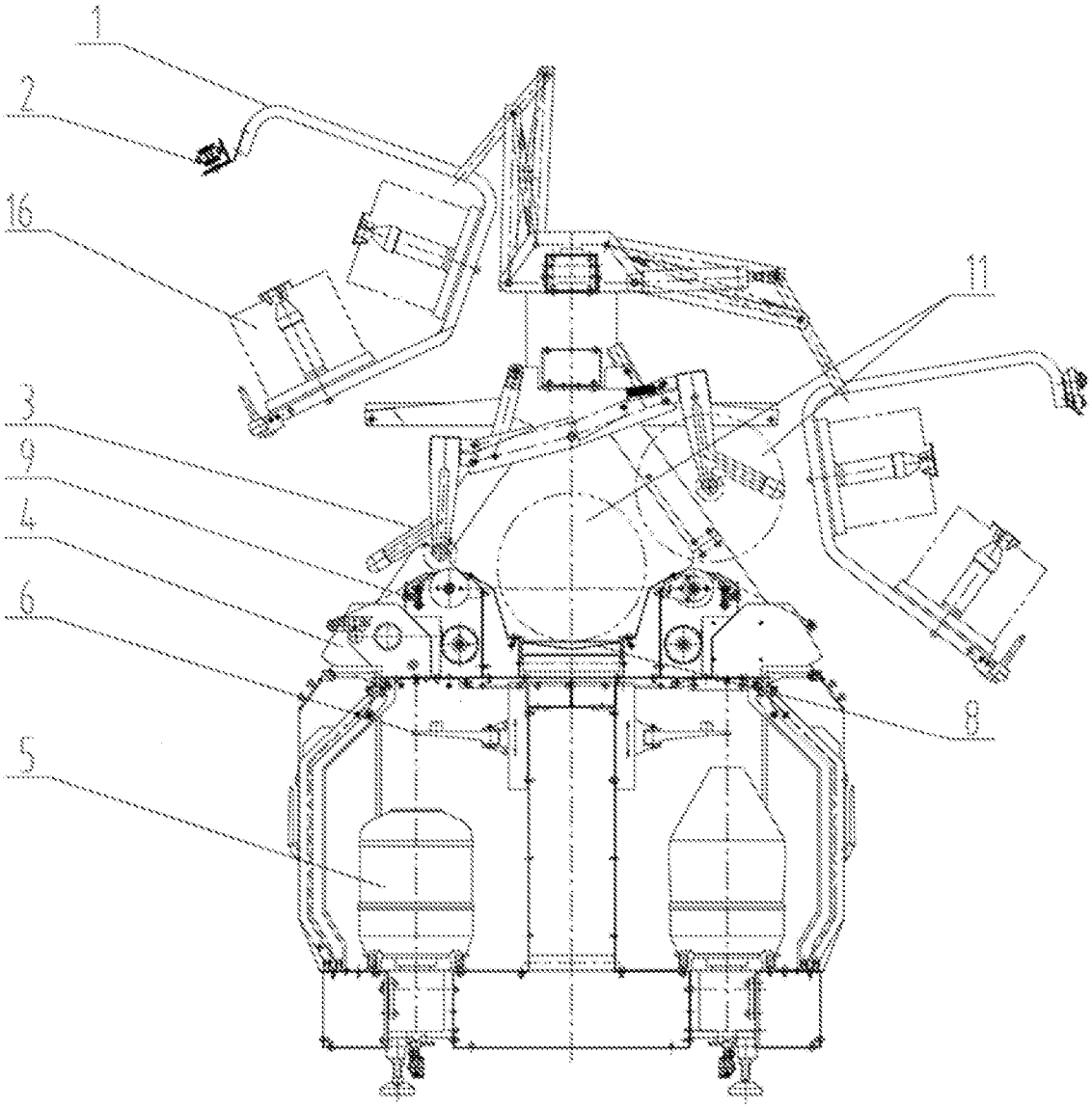
FIG. 1 is a lateral structural view of the present invention.
Figure 2:
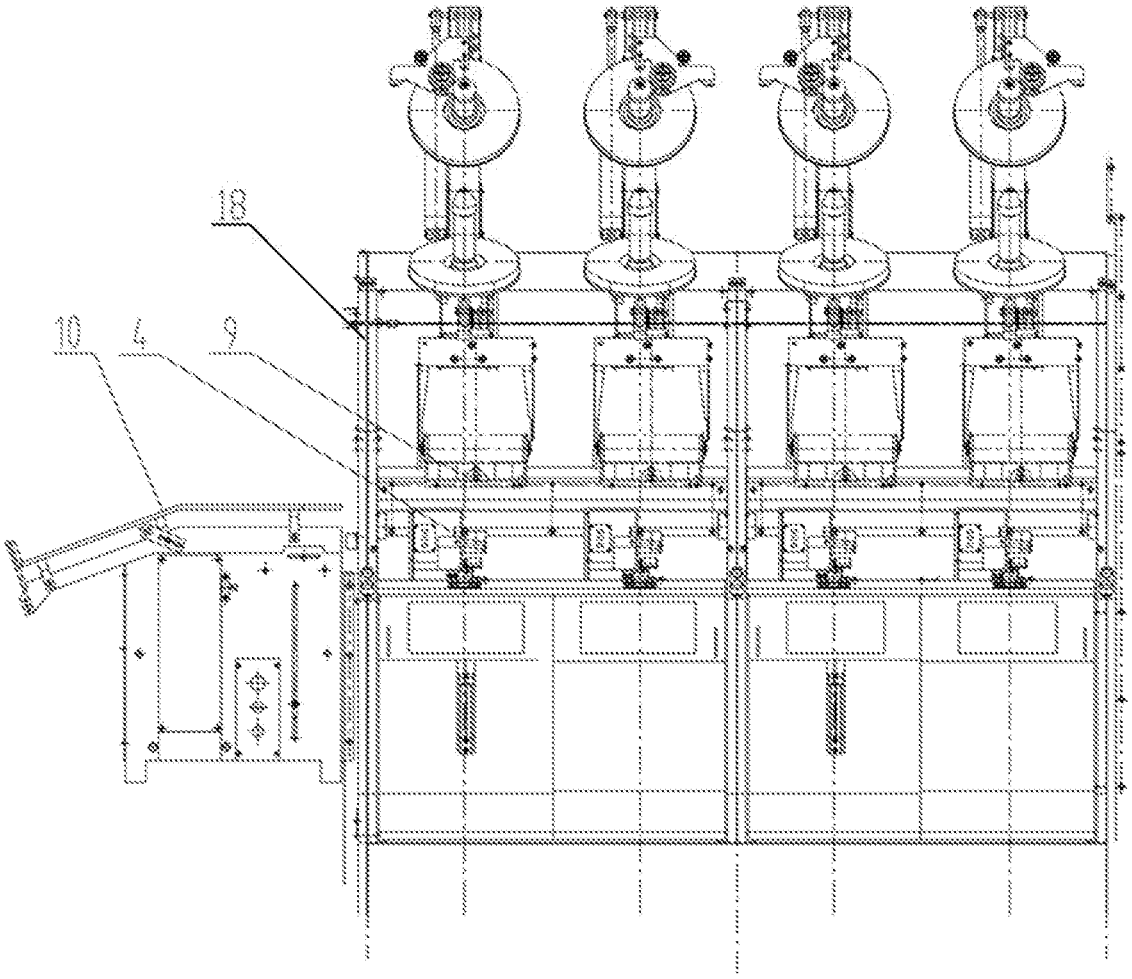
FIG. 2 is a front structural view of the present invention.

In the figures: creel unit 1, tension unit 2, driven tension roller 201, driving tension roller 202, tension air cylinder 203, transmission 204, fork-shaped tension bracket 205, ceramic ring 206, air pipe 207, electromagnetic proportioning valve 208, air pressure sensor 209, yarn guide wheel 210, tension rod bearing 211, sealed housing 212, tension rod blade 213, damping medium 214, lock nut 215, nut sleeve 216, tension motor 217, tension rod 218, reeling unit 3, reeling bracket 301, reeling roller 302, transmission shaft 3021, transmission roller end cap 3022, transmission roller bearing 3023, middle transmission member 3024, reeling roller spring 3025, friction disc 3026, friction sheet 3027, reeling roller inner barrel 3028, reeling roller electromagnetic coil 3029, reeling roller outer barrel 3020, overfeeding unit 4, tension compensating rod 401, driving overfeeding roller 402, driving gear 4021, driven gear 4022, clutch disc 4023, electromagnetic clutch 4024, spring 4025, shaft 4026, roller body 4027, driven overfeeding roller 403, yarn guide wheel 404, electric spindle unit 5, motor 501, hollow spindle rod 502, yarn guide wheel component 503, yarn discharge hole 504, yarn storage disc 505, twisting disc 506, balance ring 507, magnet base 508, spindle rod bearing 509, bearing base 510, spindle tank inner rod 511, lower spindle tank 512, upper spindle tank 513, inner yarn tensioner 514, two-in-one inner spindle rod 515, upper steel lining 5151, lower steel lining 5152, spindle rod ceramic ring base 5154, sliding inner spindle rod 5155, inner spindle rod spring 5156, inner spindle rod base 5157, two-in-one spindle wing 516, spindle tank magnet 517, yarn guide unit 6, nozzle 7, twisting package conveyor 8, transverse yarn guide 9, twisting package unloading unit 10, twisting package 11, outer yarn pipe 12, external yarn 13, ballooning 14, inner yarn package 15, outer yarn package 16, twisted yarns 17, machine frame 18, bearing 4028, bracket 4029, coil 4030, convex ring 3030.

DETAILED DESCRIPTION

As shown in FIGS. 1, 2, and 4-6, a carpet yarn twisting machine includes a machine frame, a creel unit 1, an electric spindle unit 5, an overfeeding unit 4 and a reeling unit 3. In the electric spindle unit 5, a hollow spindle rod 502 is fixedly connected with a motor 501. In this embodiment, a synchronous motor is preferred. The motor 501 drives the hollow spindle rod 502 to rotate. A yarn channel through which external yarns pass is formed in the center of the hollow spindle rod 502. A twisting disc 506 and a yarn storage disc 505 are fixedly connected with the hollow spindle rod 502 and rotate along with the hollow spindle rod.

The yarn storage disc 505 is provided with yarn outlets 504 which communicate with inner yarn channels of the hollow spindle rod 502 such that the external yarns 13 go out.

Spindle tanks for accommodating inner yarn packages 15 are connected with the hollow spindle rod 502 through spindle rod bearings 509, and the spindle tanks are immobile. In the present invention, the motor directly drives the hollow spindle rod 502 to rotate. The external yarns enter the hollow spindle rod 502 via the external yarn pipe 12, and then are thrown out via the yarn outlets 504 to form ballooning, next merged and twisted with the internal yarns to form twisted yarns 17, and the twisted yarns pass through the overfeeding unit 4 and the reeling unit 3 to form the twisting packages 11.

The motor directly drives the spindle to revolve at a high speed, and the revolving speed of the spindle is higher than the tangential belt type or spindle belt type transmission, which is 2,000-4,000 rpm.

Figure 6:
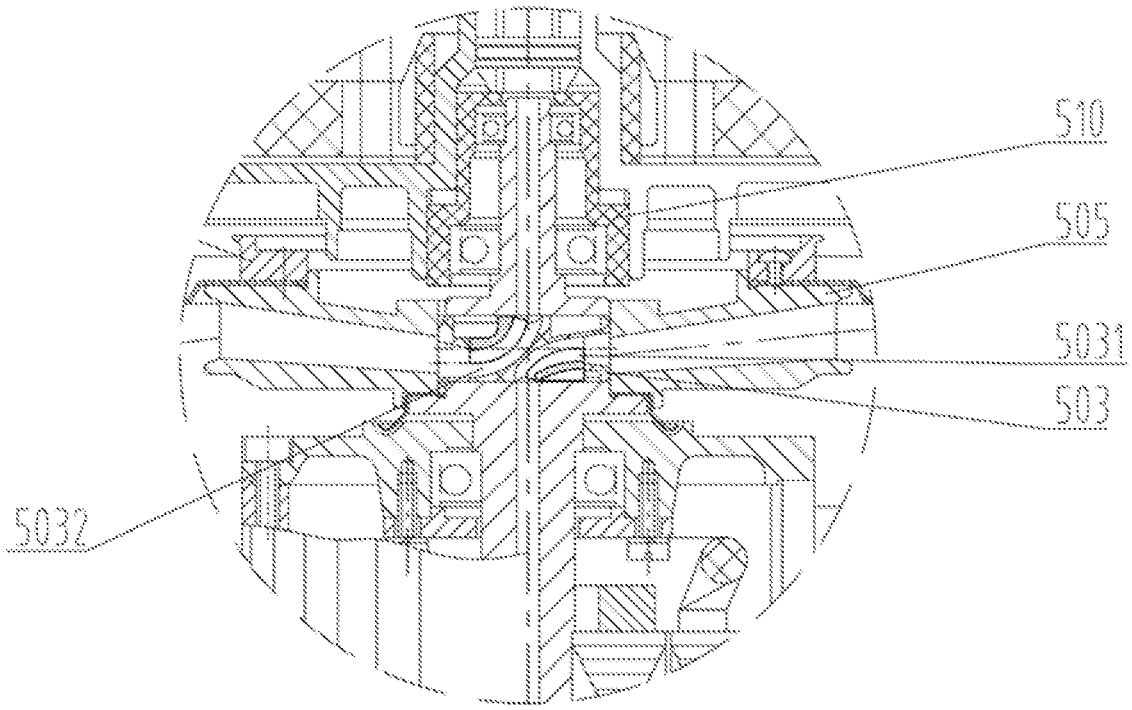
FIG. 6 is a partially enlarged view of position C in FIG. 4.
Figure 7:
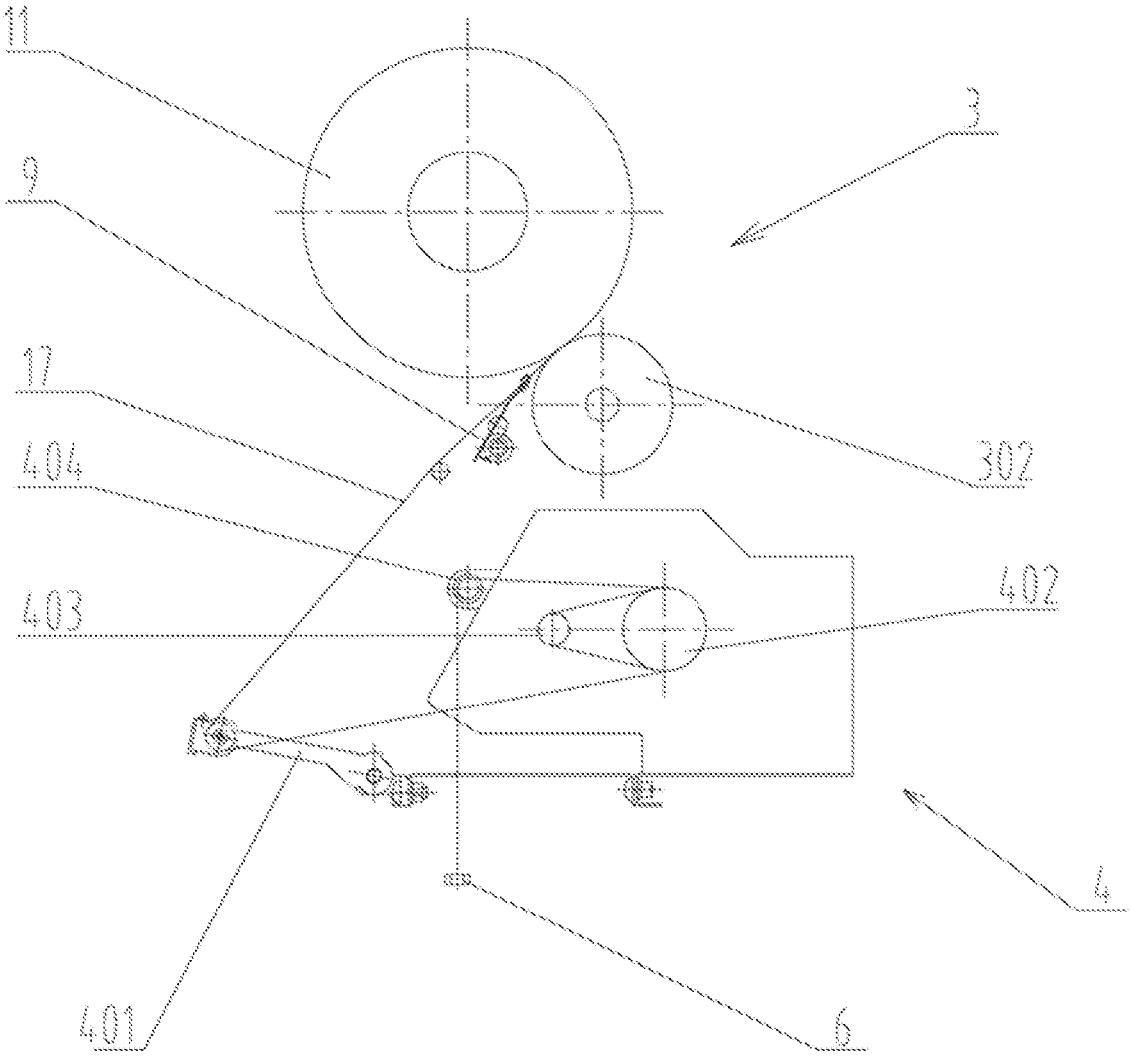
FIG. 7 is structural view of a reeling unit and an overfeeding unit of the present invention.

In an optimized solution, as shown in FIG. 6, the hollow spindle rod 502 is fixedly connected with the yarn guide base 503. The yarn guide base 503 is fixedly connected with the yarn storage disc 505. The twisting disc 506 with a diameter greater than the diameter of the yarn storage disc 505 is fixedly connected with the yarn storage disc 505. The twisting disc 506 is positioned above the yarn storage disc 505.

The yarn guide base component 503 is a universal component for both direct twisting and two-in-one twisting. The yarn guide base component 503 is provided with two yarn channels, which do not communicate with each other and go from the vertical direction to the horizontal direction. The horizontal tails of the yarn channels are expanding structures, and of the vertical tails of the two yarn channels, one faces upward while the other one faces downward, as shown in FIG. 6.

The yarn storage disc 505 is provided with two yarn outlets 504 corresponding to the two yarn channels.

The hollow spindle rod 502 is provided with a step shaft at the top; at least two spindle rod bearings 509 are sleeved on the step shaft; bearing base 510 are respectively sleeved on corresponding spindle rod bearings 509; and lower spindle tanks 512 among the spindle tanks are sleeved with the bearing bases 510.

Each one of the lower spindle tanks 512 is provided with a plurality of spindle tank magnets 517. A magnet base 508 is disposed at a position outside the lower spindle tanks 512 and corresponding to the spindle tank magnets 517. The magnet base 508 is fixedly installed on the machine flame. The magnet base 508 does not contact the lower spindle tanks 512. The magnet base 508 and the spindle tank magnets 517 generate a magnetic force to make the spindle tanks immobile.

Figure 4:
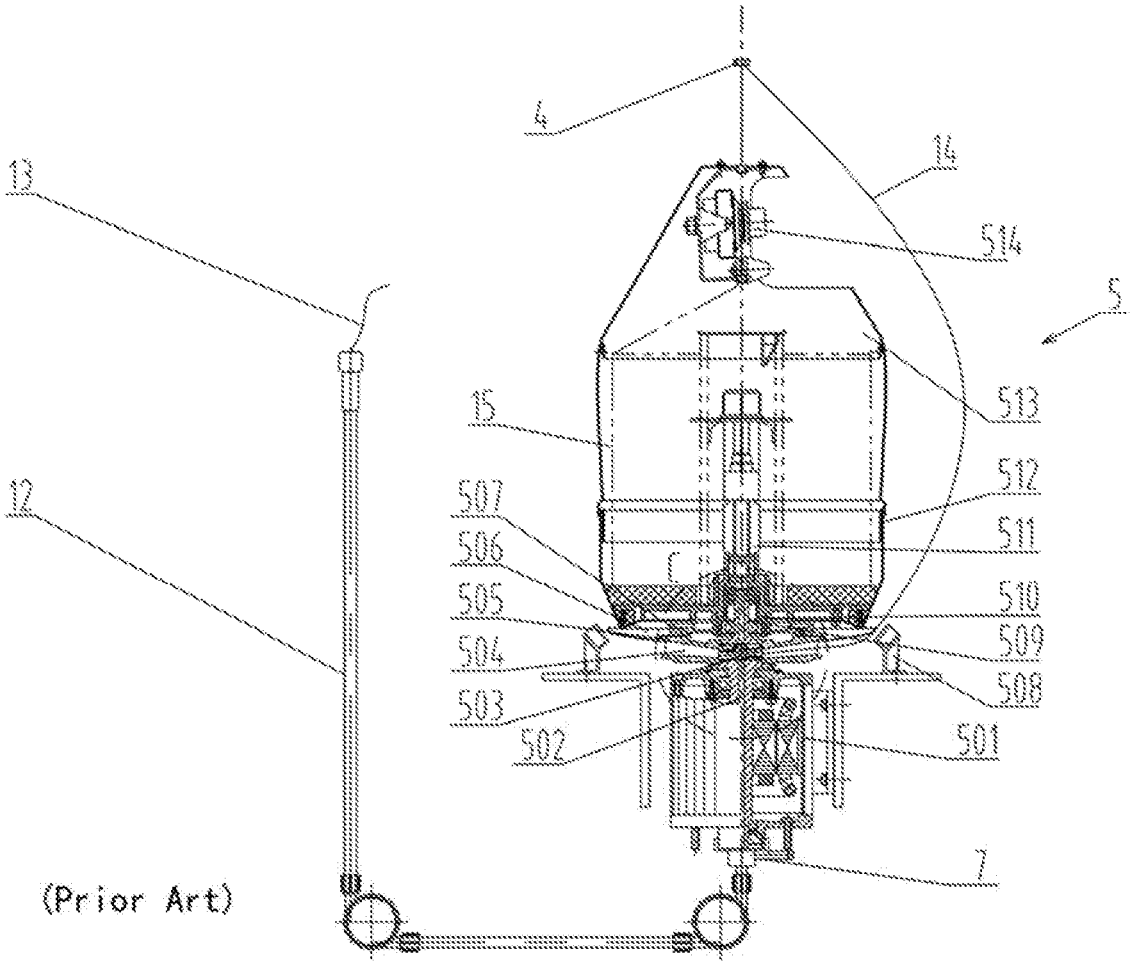
FIG. 4 is a structural view of an electric spindle unit in the direct twisting state of the present invention.
Figure 5:
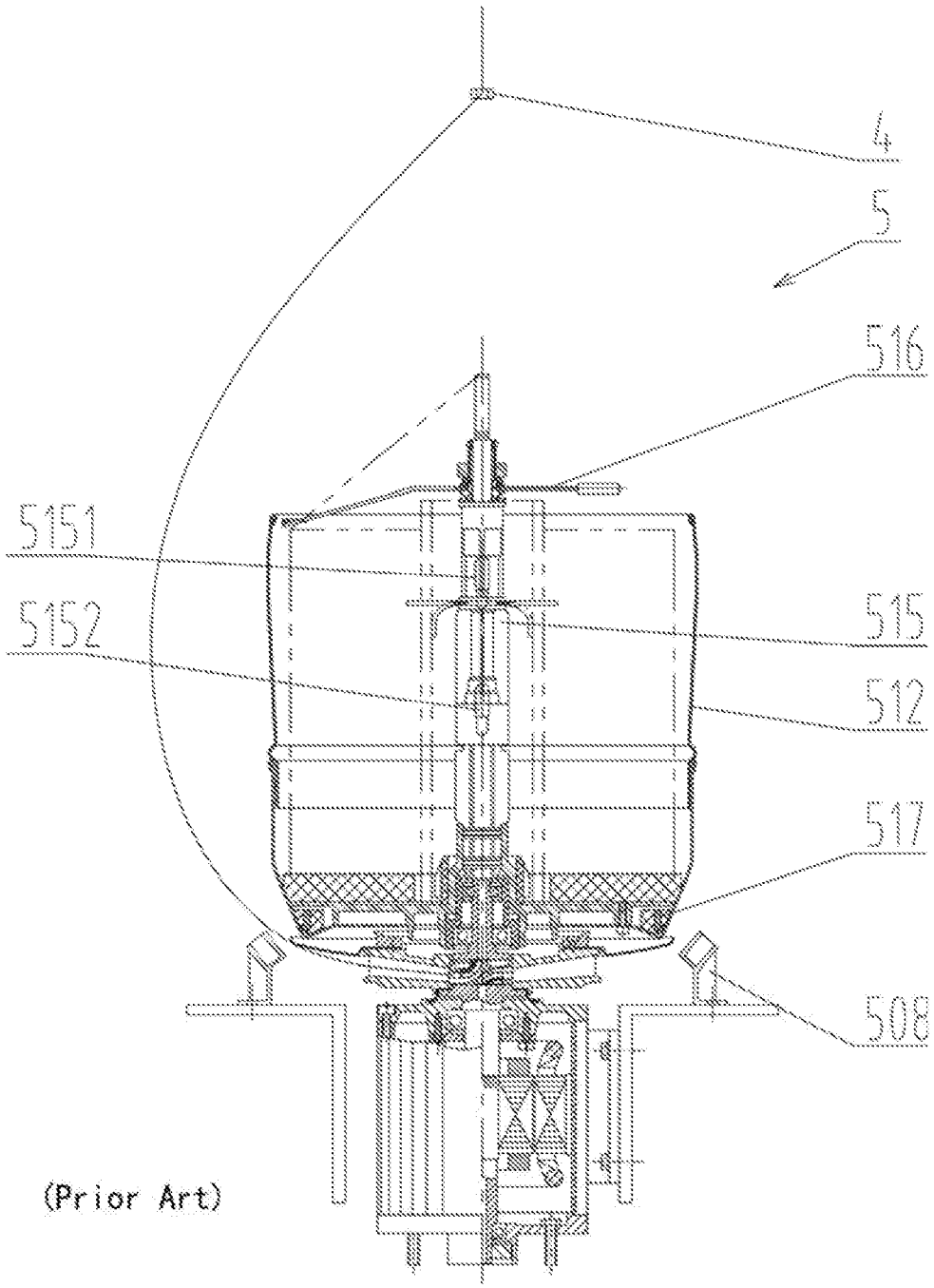
FIG. 5 is a structural view of the electric spindle unit in the two-in-one twisting state of the present invention.

In an optimized solution, as shown in FIGS. 4-6, the twisting disc 506 is provided with a balance ring 507 for adjusting the rotation balance of a whole rotary part through counterbalances installed on the balance ring.

In optimized solution, as shown in FIG. 1, a twisting package conveyor 8 is disposed below the reeling unit 3. The twisting package conveyor 8 is a belt conveyor that penetrates through the whole twisting station. The twisting package conveyor 8 is provided with a twisting package unloading unit 10 at the tail, and the twisting package unloading unit 10 is provided with an inclined slideway for conveying twisting packages. The twisting packages 11 of the carpet yarns are usually large in volume, so the twisting package conveyor 8 working with the twisting package unloading unit 8 can reduce the labor consumption of operators and lower the labor intensity.

In an optimized solution, as shown in FIG. 4 and FIG. 5, a replaceable spindle tank inner rod 511 which is fixedly connected with each one of the spindle tank 512 is also provided.

As shown FIG. 5, each one of the spindle tank inner rods 511 includes a two-for-one twisting inner spindle rod 515 for two-in-one twisting; the bottom of the two-for-one twisting inner spindle rod 515 is sleeved with each corresponding one of the lower spindle tanks 512; the top of the two-for-one twisting inner spindle rod 515 is provided with a two-for-one twisting spindle wing 516; the two-for-one twisting spindle wing 516 is a suspending arm structure; the suspending arm is provided with a ceramic ring through which internal yarns pass at the free end; the two-for-one twisting inner spindle rod 515 is formed with an axial through-hole in the middle; and, the through-hole communicates with the yarn channels with upward tails in a vertical direction in a yarn guide base component 503.

A shaft is disposed in the center of the through-hole of the two-for-one twisting inner spindle rod 515; an upper steel lining 5151 and a lower steel lining 5152 are also disposed in the through-hole; the upper steel lining 5151 and the lower steel lining 5152 are penetrated on the shaft in the center of the through-hole. The tension of the internal yarns is adjusted using the friction force between the upper steel lining 5151 lower steel lining 5152 and the internal yarns.

Figure 15:
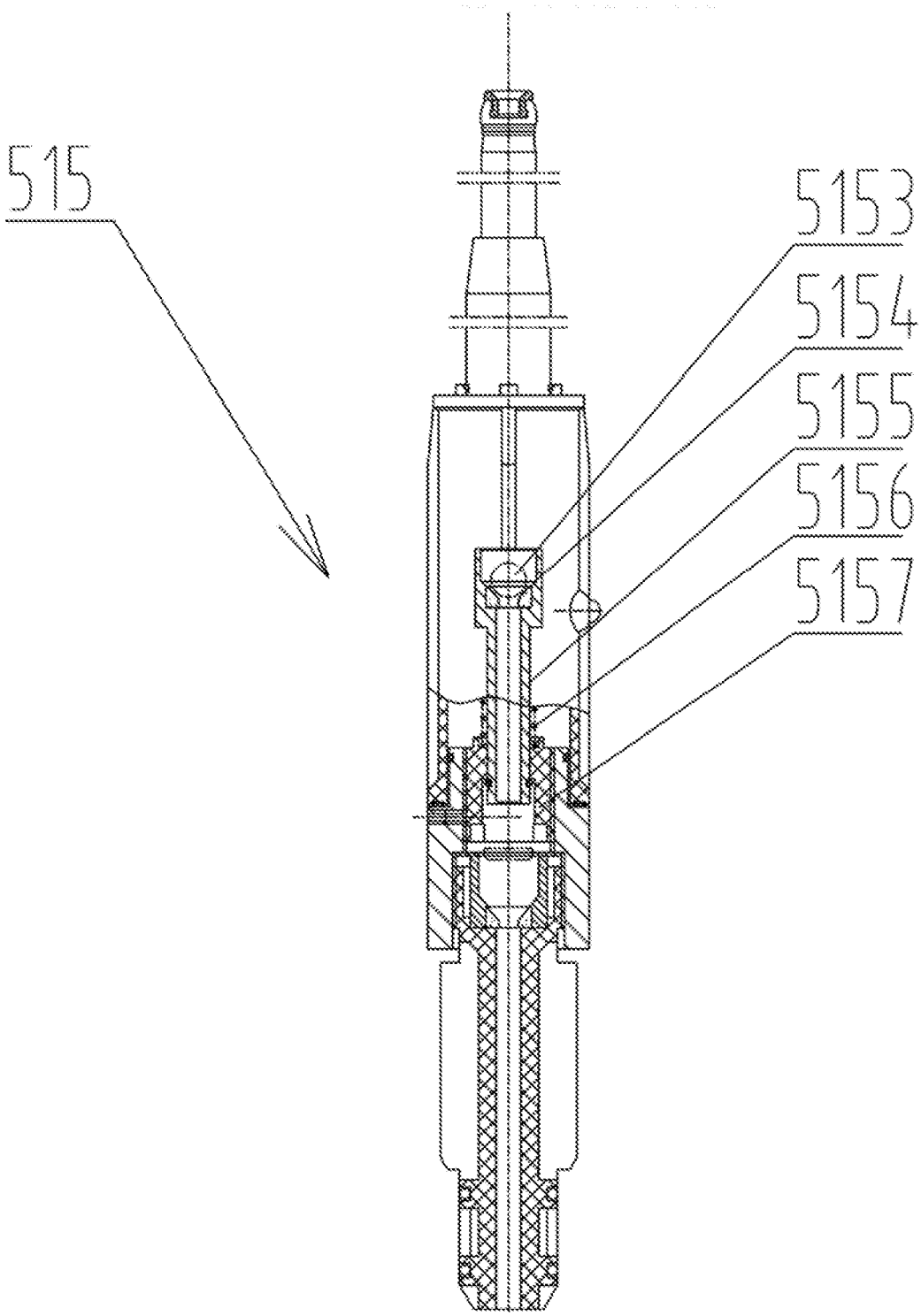
FIG. 15 is a structural view of a steel ball type tensioner.

Or, as shown in FIG. 15, a steel ball type two-in-one tensioner is disposed in the through-hole of the two-in-one twisting inner spindle rod 515, wherein the structure of the steel ball type two-in-one tensioner is that: the two-in-one twisting inner spindle rod 515 is internally provided with a sliding inner spindle rod 5155; the sliding inner spindle rod 5155 is sleeved with an inner spindle rod base 5157 in a sealing and sliding way; an inner spindle rod spring 5156 is disposed between the inner spindle rod base 5157 and the sliding inner spindle rod 5155; the sliding inner spindle rod 5155 is provided with a spindle rod ceramic ring base 5154 at the top; the spindle rod ceramic ring base 5154 has a swelling cavity inside; a ceramic ring with a tapered upper opening is disposed at the bottom of the cavity, and the spindle rod ceramic ring base 5154 is internally provided with a steel ball 5153. Such structure can increase the tension of the internal yarns. When the internal yarns pass through the steel ball 5153, the friction force drives the steel ball to move downward. The internal yarn drives the sliding inner spindle rod 5155 to overcome the spring force of the inner spindle rod spring 5156 and move downward. When the sliding inner spindle rod 5155 moves downward, the air pressure in the air ducts below the steel ball 5153 increases, and the increased air pressure reduces the pressure between the steel ball 5153 and the internal yarns. When the friction force of the internal yarns is reduced, the sliding inner spindle rod 5155 springs back by the effect of the inner spindle rod spring 5156, and the air pressure in the air ducts below the steel ball 5153 decreases while the friction force between the internal yarns and the steel ball 5153 increases. This cycle is repeated, realizing adjustment on the tension of the internal yarns.

By replacing different spindle tank inner rods 511, the direct twisting or the two-in-one twisting mode can be switched.

In an optimized solution, as shown in FIG. 1, a liftable yarn guide unit 6 is disposed at the top of each one of the spindle tanks; the liftable yarn guide unit 6 can adjust the position of the top of the ballooning 14 to adjust the form of the ballooning. Usually, the smaller the diameter is, the lower the power consumption of the ballooning is. Of course, it should be ensured that the external yarns 13 forming the ballooning 14 do not generate friction with the upper spindle tanks 512 or the upper spindle tanks 513 of the spindle tanks.

A yarn guide unit 6 is internally provided with a suspending arm structure; the base of the suspending arm structure vertically slides along the machine frame; a ceramic ring through which yarns pass is disposed at the free end of the suspending arm structure; the axis of the ceramic ring is superimposed with the axis of the hollow spindle rod 502; and a mechanism for driving the yarn guide unit 6 to move up and down includes a belt mechanism and a screw-and-nut mechanism or a pinion-and-rack mechanism. The driving mechanism is not shown in the figure.

In an optimized solution, as shown in FIG. 7 and FIGS. 11-13, in the overfeeding unit 4, driving overfeeding rollers 402 and driven overfeeding rollers 403 are arranged with an interval therebetween.

Figure 12:
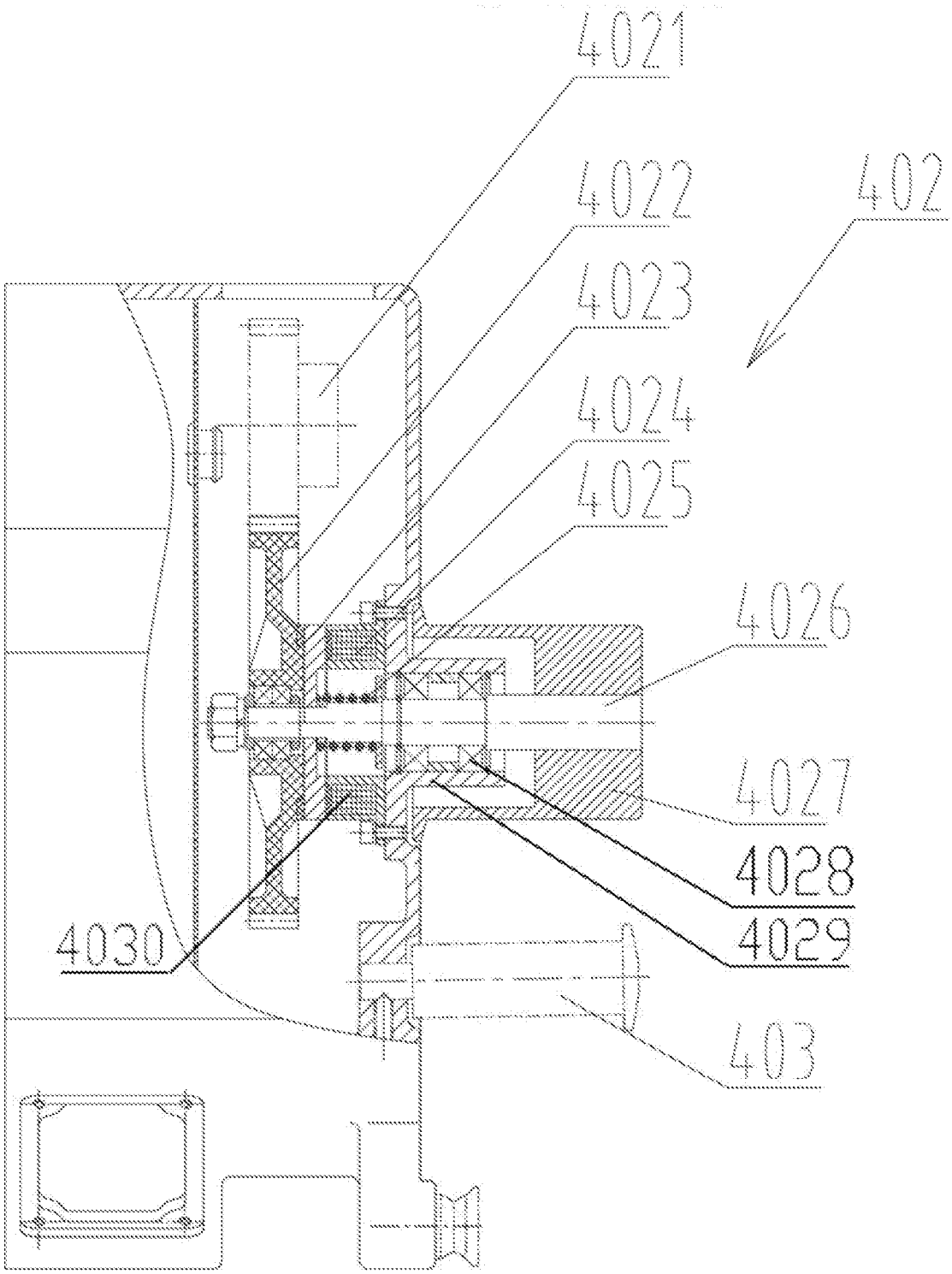
FIG. 12 is a top view of the overfeeding unit of the present invention.

The driven overfeeding rollers 403 are inclined relative to the axes of the driving overfeeding rollers 402, as shown in the FIG. 12, so circles of twisting yarns reeled on the driving overfeeding rollers 402 and driven overfeeding rollers 403 do not contact one another.

The driving overfeeding rollers 402 are connected with the driving unit through the transmission mechanism; the transmission mechanism is internally provided with an electromagnetic clutch 4024 for cutting off or passing power transmission of the driving overfeeding rollers 402; the electromagnetic clutch 4024 is controlled according to the tension of the twisted yarns 17 such that the power of the roller bodies 4027 is connected or cut off to compensate the overfeeding control error.

The linear speed of the surfaces of the driving overfeeding rollers 402 is higher than that of the surfaces of reeling rollers 302 in the reeling unit 3, and the ratio of the two linear speeds is called overfeeding ratio. The overfeeding ratio is mainly achieved through adjusting the revolving speed of the driving motor.

In the optimized solution, as shown in FIG. 12, in each one of the driving overfeeding rollers 402, a driving gear 4021 is in an engaged connection with a driven gear 4022, while the driven gear 4022 is connected with a shaft 4026 through a bearing; the shaft 4026 is fixedly connected with a roller body 4027; the shaft 4026 is connected with a bracket through the bearing; a clutch disc 4023 is installed on the shaft 4026 in an axial sliding way; the clutch disc 4023 is capable of driving the shaft 4026 to rotate; an end face of the clutch disc 4023 and an end face of the driven gear 4022 are in a separable transmission connection; the shaft is provided with a spring 4025 for compressing the clutch disc 4023 toward the driven gear 4022 and is also fixedly provided with an electromagnetic clutch 4024; and the electromagnetic clutch 4024 is internally provided with a coil for absorbing the clutch disc 4023 and overcoming the spring force of the spring 4025 and separating the clutch 4023 from the driven gear 4022. By default, the driving gears 402 drive the driven gears 4022, the clutch discs 4023, the shafts 4026 and the rollers 4027 to rotate. When the coils of the electromagnetic clutches 4024 are electrified, the transmission between the driven gears 4022 and the clutch discs 4023 is cut off.

In the present invention, the spindle is directly driven by the motor to rotate at a speed of 8,000-10,000 rpm. When the spindle of the twisting machine is rotating at a high speed, the twisted yarns generate very high twisting tension which is far greater than the twisting tension generated in the existing tangential belt driven or spindle belt driven spindle transmission mode. In the present invention, the reeling tension required for reeling the twisted yarns on the twisting packages 11 is smaller than the twisting tension, so the twisting machine in the present invention adopts the above overfeeding unit 4 with the above structure for the purpose of converting the twisting tension into the smaller required reeling tension through the overfeeding unit 4. For twisting machine in the tangential belt driven or spindle belt driven spindle mode, the spindle speed ratio is smaller than that of the twisting machine in the electric spindle mode of the present invention, and the corresponding twisting tension is also smaller, so a common yarn clamping disc type overfeeding unit can be used to reduce the yarn twisting tension to the tension required for reeling. For the winch type overfeeding unit of the present invention, the generated friction force varies with the circles of the yarns reeled on the driving overfeeding rollers 402 and the driven overfeeding rollers 403, so different reeling tensions for twisting different types of yarns can be obtained. The clamping friction force generated by the yarn clamping disc type overfeeding unit on yarns is achieved through the wrap angle and varies in a small scope, therefore the yarn clamping disc type overfeeding unit cannot be adapted to the twisting of various twisting yarns and cannot convert the very high twisting tension generated during the high-speed rotation of the electric spindle into smaller tension for reeling.

Figure 3:
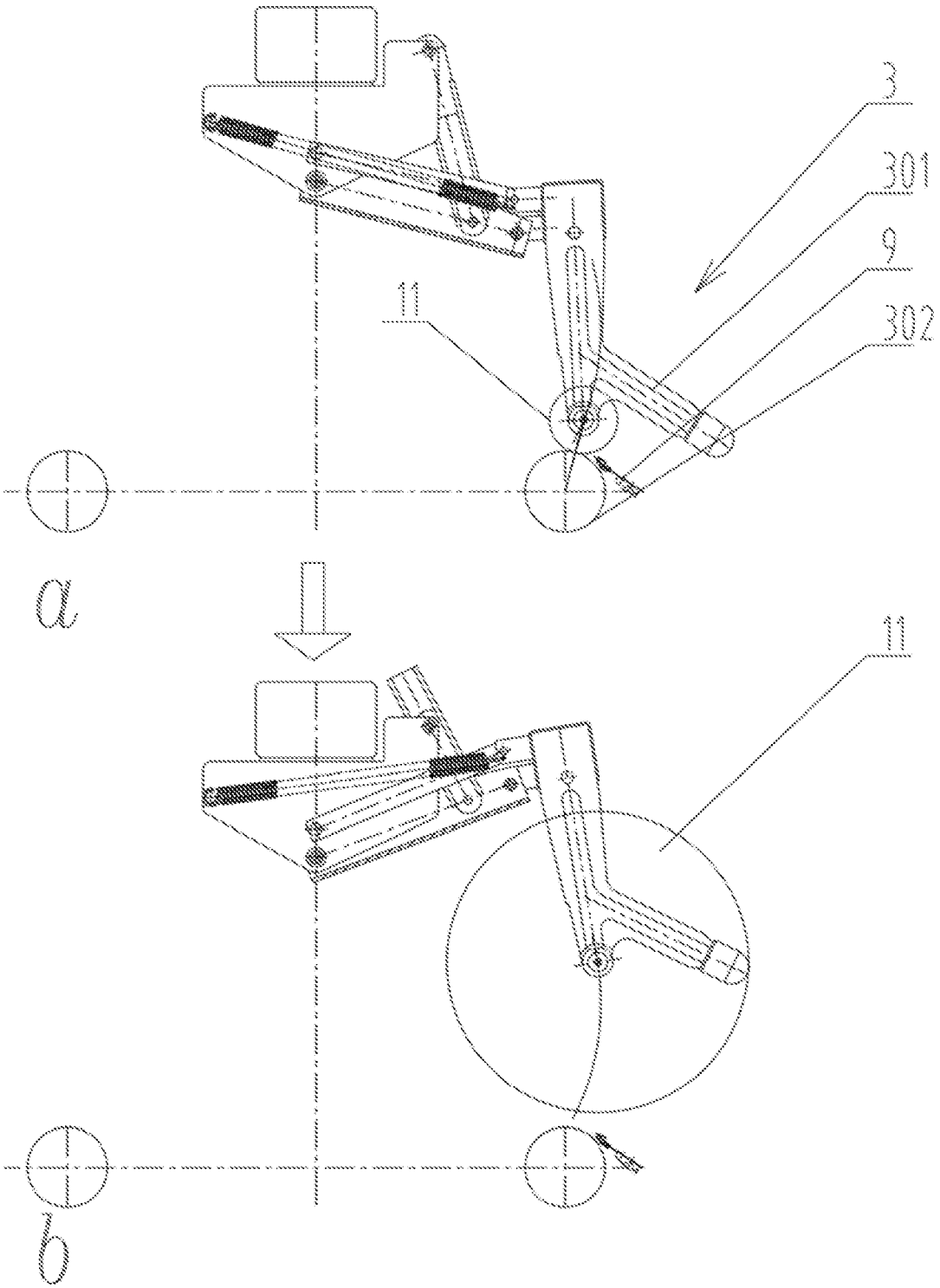
FIG. 3 is a structural view of a reeling unit of the present invention.

In the optimized solution, as shown in FIGS. 1-3 and FIG. 7, in the reeling unit 3, a reeling bracket 301 is a quadrilateral mechanism capable of swinging up and down; the reeling bracket 301 is used for installing twisting packages 11; a reeling roller 302 driven to rotate by a driven unit is disposed below each one of the twisting packages 11; the outer walls of the reeling rollers 302 contact the outer walls of the twisting packages 11; and a transverse yarn guide 9 is disposed in the yarn coming direction of the reeling rollers 302. As shown in FIG. 3, as the diameters of the twisting packages 11 increase, the reeling brackets 401 rise gradually, the reeling brackets 301 are provided with springs such that the outer walls of the twisting packages 11 generate a pressure on the outer walls of the reeling rollers 302 to increase the friction force.

Figure 14:
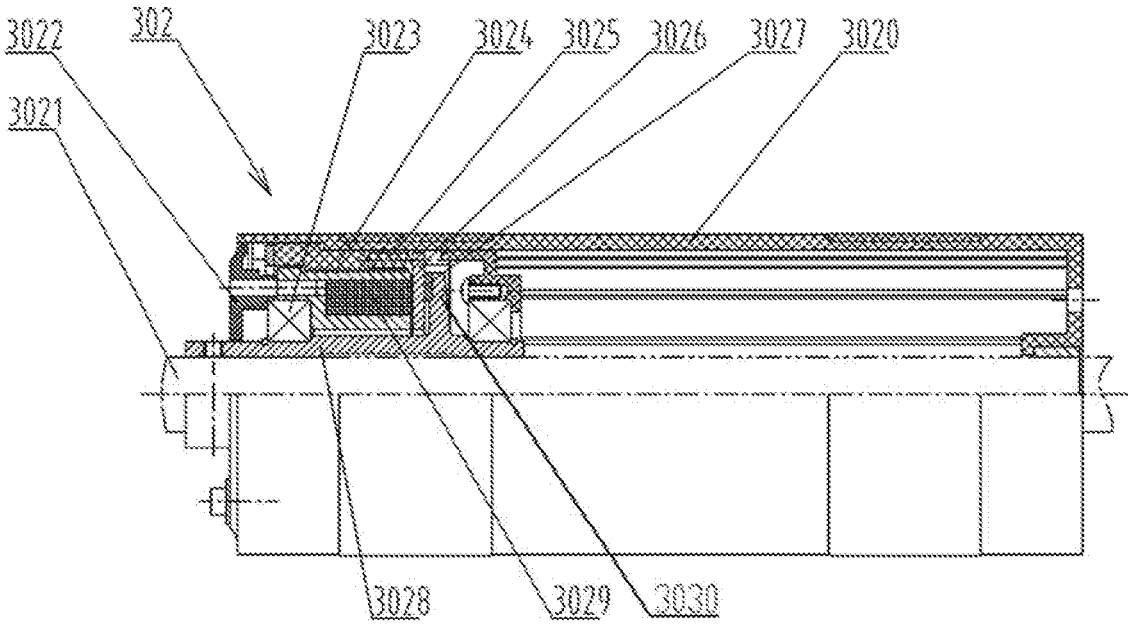
FIG. 14 is a structural view of a reeling roller of the present invention.

A further optimized solution can be seen in FIG. 14. Each one of the reeling rollers 302 is internally provided with a clutch device with a specific structure that: a reeling roller inner barrel 3028 is fixedly connected with a transmission shaft 3021, a middle transmission member 3024 is supported on the reeling roller inner barrel 3028 through two transmission roller bearings 3023, a reeling roller outer barrel 3020 is fixedly connected with the middle transmission member 3024, a friction disc 3026 is disposed on one side of the middle transmission member 3024, and the friction disc 3026 and the reeling roller outer barrel 3020 are connected in a way of being capable of moving with respect each other along the axial direction and being incapable of rotating with respect to each other. For example, the reeling roller outer barrel 3020 is provided with a projection; the friction disc 3026 is formed with a groove; the projection is positioned in the groove, limiting the relative rotation of the friction disc 3026, and the friction disc 3026 can slide along the projection. The friction disc 3026 is made of ferromagnet; the middle transmission member 3024 is internally provided with a reeling roller electromagnetic coil 3029; the reeling roller inner barrel 3028 is provided with a convex ring on the other side of the friction disc 3026; the ring is provided with a friction sheet 3027 which is matched with the friction disc 3026 to form frictional transmission, and a spring 3025 is disposed between the middle transmission member 3024 and the friction disc 3026. By default, the reeling roller electromagnetic coils 3029 are in the power-off state; by the effect of the reeling roller springs 3025, the friction discs 3026 and friction sheets 3027 perform friction transmission there-between; and the transmission shafts 3021 drive the reeling roller outer barrels 3020 to rotate. When a station has faults, for example yarn break fault, the control unit, for example the PLC, controls the reeling roller electromagnetic coil 3029 of the station to be electrified while the friction disc 3026 overcomes the spring force of the reeling roller spring 3025 to separate from the friction sheet 3027, and then the reeling roller outer barrel 3020 stops rotating, thus facilitating troubleshooting by the operator.

Figure 13:
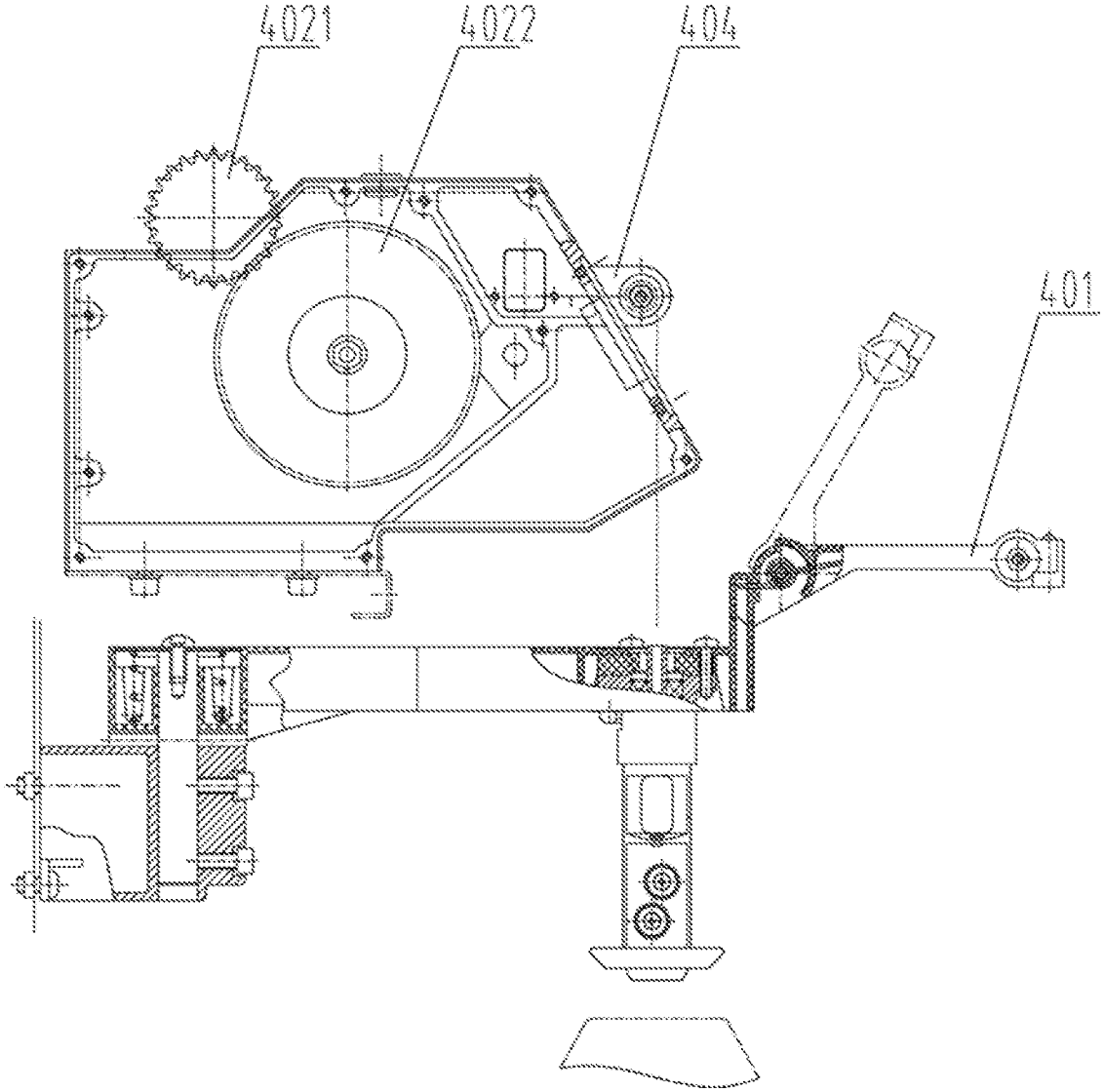
FIG. 13 is a left view of the overfeeding unit of the present invention.

In an optimized solution, as shown in FIG. 1 and FIG. 13, a tension compensating rod 401 is disposed between the overfeeding unit 4 and the reeling unit 3; one end of the tension compensating rod 401 is hinged with the machine frame while the other end is provided with a yarn wheel; twisted yarns going out of the overfeeding unit 4 are coiled on the yarn wheel and then enter the reeling unit 3 via the transverse yarn guide 9 such that the tension compensating rod 401 swings to be close to vertical and horizontal alternatively according to the tension. The reeling tension can be obtained through the tiling angle of the tension compensating rod 401. Preferably, an angle sensor is disposed at a position where the tension compensating rod 401 and the machine frame are hinged. The overfeeding ratio is controlled according to the information fed back by the angle sensor. The angle sensor is not shown in the figures. As shown in FIG. 13, when the twisted yarns 17 generate relatively high tension, the tension compensating rod 401 is closer to be vertical state. According to the information fed back by the angle sensor, the control unit, for example PCL, controls the driving motor in the overfeeding unit 4 to speed up, When the tension compensating rod 401 is closer to horizontal state, the control unit controls the driving motor to slow down.

In an optimized solution, as shown in FIG. 1, a tension unit 2 is also provided; and the tension unit 2 is disposed between the creel unit 1 and the electric spindle unit 5. The tension unit is used for adjusting the tension of the external yarns 13 to control the ballooning 14.

Figure 8:
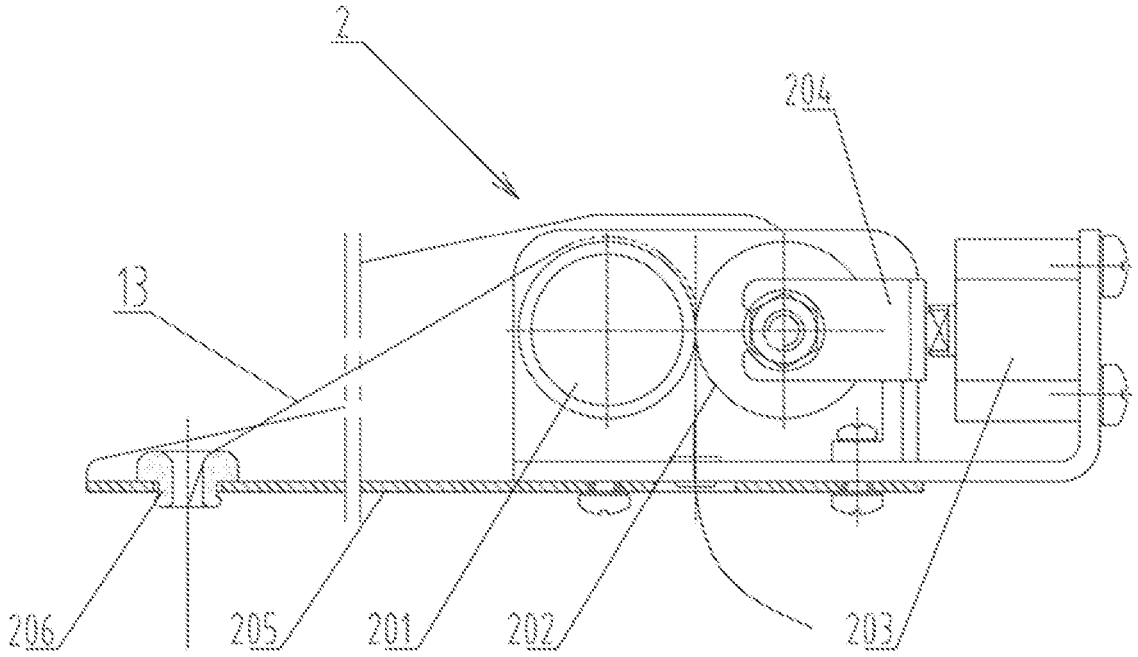
FIG. 8 is a structural view of a pneumatic tension unit of the present invention.
Figure 9:
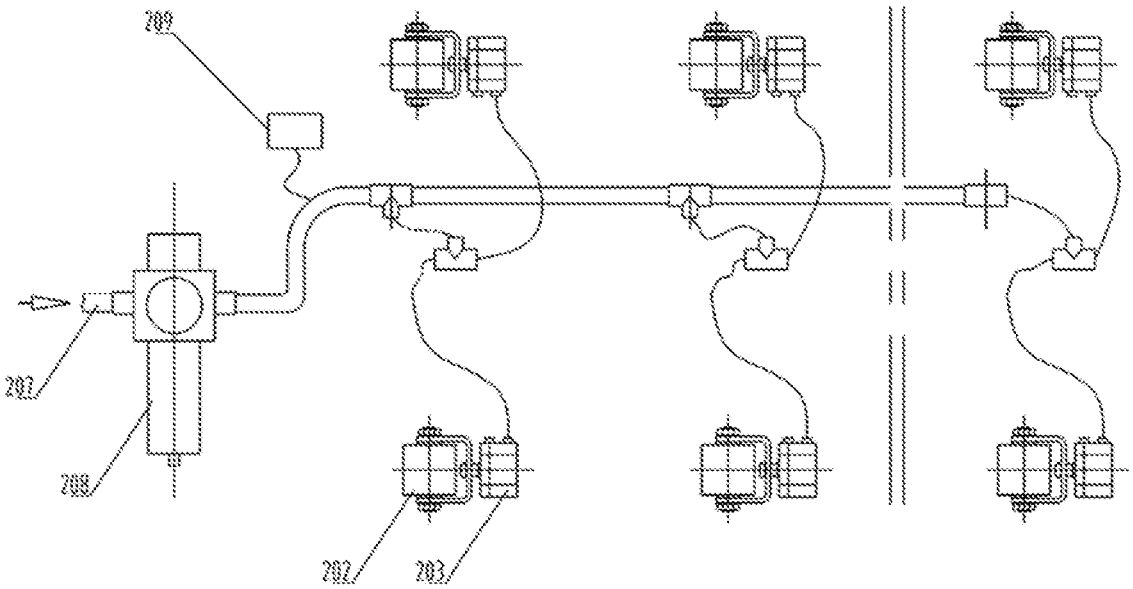
FIG. 9 is a structural view of connection of a plurality of pneumatic tensioner units of the present invention.

In an optional solution, as shown in FIG. 1, FIG. 8, FIG. 9, the tension unit 2 is disposed on the creel unit 1; the tension unit 2 includes driven tension rollers 201 and driving tension rollers 202 of which the outer walls contact one another, the driven tension rollers 201 are fixedly installed, the driving tension rollers 202 are connected with tension air cylinders 203 through fork-shaped tension brackets 205; the tension air cylinders 203 communicate with air pipes 207, and each one of the air pipes 207 is provided with an electromagnetic proportioning valve 208 and an air pressure sensor 209. The on-off of the electromagnetic proportioning valves 208 is controlled through the input compressed air; the piston rods of the tension air cylinders 203 extend out to transmit the pressure from the driving tension rollers 202 to the driven tension rollers 201 to adjust the tension of the external yarns 13. This embodiment has the advantages of simple structure, utilization of existing air sources, and brings convenience in realization of automatic control.

Figure 10:
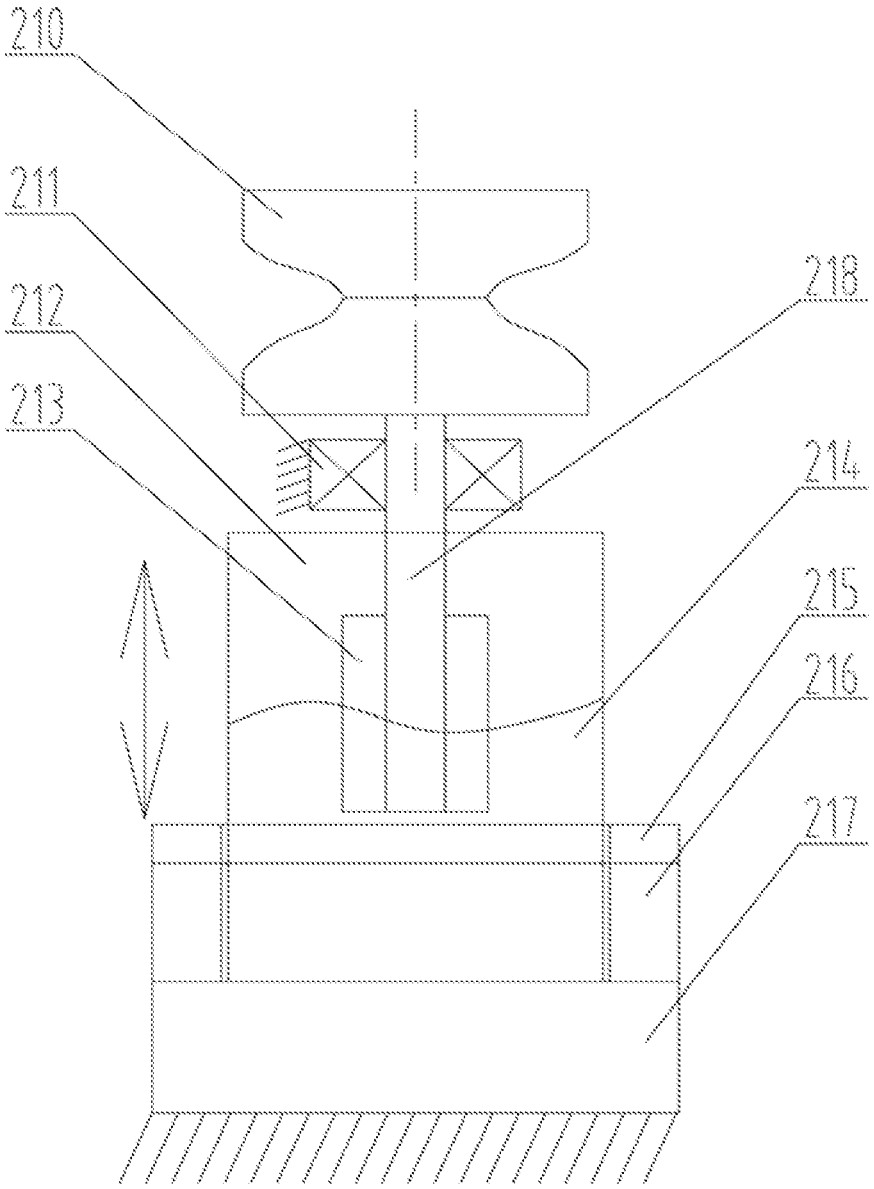
FIG. 10 is a structural view of connection of liquid tension units of the present invention.
Figure 11:
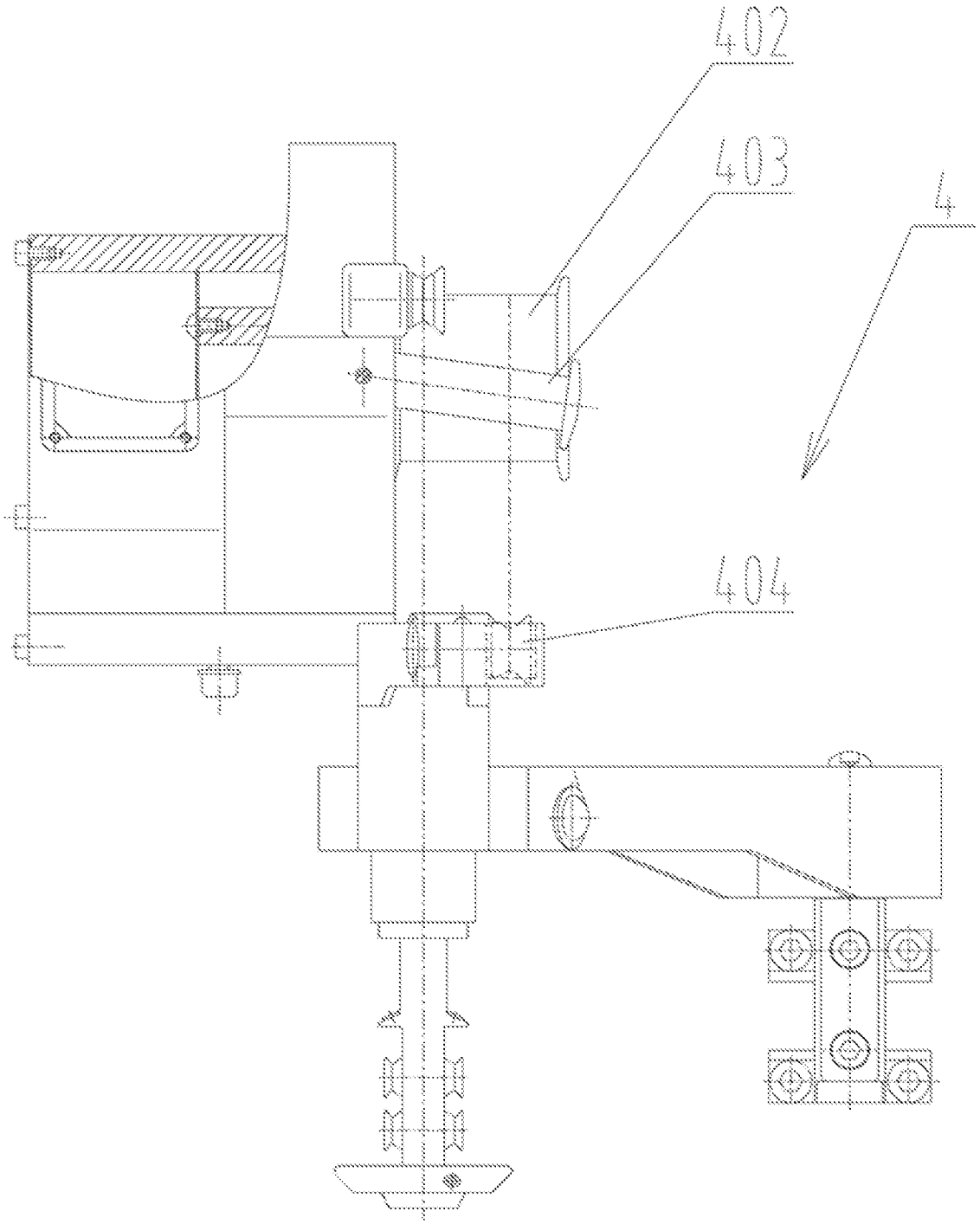
FIG. 11 is a front view of the overfeeding unit of the present invention.

Or, in another optional solution, as shown in FIG. 10, the tension unit 2 is disposed on the machine frame; a tension roller or a yarn guide wheel 210 is fixedly connected with one end of a tension rod 218; the tension rod 218 is supported on a fixed tension rod bearing 211; the other end of the tension rod 218 extends into a sealed housing 212; the portion, in the sealed housing 212, of the tension rod 218 is provided tension rod blades 213; the sealed housing 212 is internally filled in with damping medium 214; the tension rod 218 and the sealed housing 212 are in a sliding connection; a tension motor 217 and a nut sleeve 216 are in a fixed connection; the nut sleeve 216 and the sealed housing 212 are in a threaded connection; by rotating the nut sleeve 216, the axial position of the sealed housing 212 is capable of being adjusted, and the depth of the tension rod blades 213 in the damping medium 214 is capable of being adjusted. First, the sealed housing 212 is rotated to adjust the position of the sealed housing 212 at the nut sleeve 216, namely to adjust the insertion depth of the tension rod blades 213 in the damping medium 214. In this embodiment, the damping medium 214 is light mineral oil. Then, the lock nut 215 is locked. At this time, the initial tension is generated. Usually, the minimum tension required by the external yarns 13 is set as the initial tension. As the equipment runs and when higher tension is required, the tension motor 217 is started to rotate to drive the sealed housing 212 and the damping medium 214 to rotate, and then the damping of the tension rod blades 213 increase, thus dynamically adjusting the tension. The tension adjustment of this structure achieves the effect of smooth tension fluctuation and change.

Direct Twisting Mode:

During direct twisting, the external yarns 13 are imported from the outer yarn packages 16 of the creel unit 1. The pulling force comes from the driving overfeeding rollers 402 of the overfeeding unit 4. The external yarns 13 pass through the tension unit 2 while receiving a certain resistance. In this embodiment, the tension unit 2 includes a pneumatic tensioner, an electromagnetic tensioner and a liquid medium type tensioner. By the effect of a nozzle 7, the external yarns 13 pass through the outer yarn pipes 12 in turn in virtue of a negative pressure, enter the hollow spindle rod 502, pass through a direct twisting yarn channel 5031, and are thrown out via the yarn outlets 504 of the yarn storage disc 505. Due to the rotation of the yarn storage disc 505 and the twisting disc 506, the external yarns 13 form a certain wrap angle on the outer circle face of the yarn storage disc 505, and then form a ballooning 14 close to the outer circular arc face of the bottom of the twisting disc 506. The yarn guide unit 6 is positioned above the ballooning 13. The external yarns 13 pass through the ceramic hole of the yarn guide unit 6 on the extension line of the axis of the hollow spindle rod 502. The yarn guide unit 6 adjusts the height position according to the ballooning form. The internal yarns of the inner yarn packages 15 are exported from the inner yarn packages 15 of the spindle tanks, pass through the inner yarn tension 514, and then are merged with the external yarns 13 at the ceramic hole of the yarn guide unit 6 to form the twisted yarns 17. The twisted yarns 17 are coiled on the surfaces of the driving over feeding rollers 402 and the driven overfeeding rollers 403 of the overfeeding unit 4 by several cycles, and driving motors in the driving overfeeding rollers 402 rotate to generate a pulling force to pull the twisted yarns 17. In the overfeeding unit 4, the shafts of the driving gears 4021 are connected with the driving motors, and the driving gears 4021 are in an engaged connection with the driven gears 4022, so a lateral end face of each one of the driven gears 4022 contacts with a corresponding one of the clutch discs 4023 in a clutching way. When the driven gears 4022 contact the clutch discs 4023, the power can be transmitted to the shafts 4026, and when the contact is cut off, the power cannot be transmitted to the shafts 4026. A spring 4025 is disposed on one side of each one of the clutches 4024. By default, the spring 4025 compress the clutch 4023 onto one lateral end face of each corresponding one of the driven gear 4022 to keep transmission. On the same side of the spring 4025, an electromagnetic clutch 4024 is also provided, and the magnetic force generated by the electromagnetic clutch 4024 is big enough such that the clutch 4023 overcomes the spring force of the spring 4025 to separate from the lateral end face of the driven gear 4022, thus cutting off the power transmission. When the tension of the twisted yarns 17 is too high or a fault occurs, the electromagnetic clutch 4024 actuates once, for example releasing the excessive tension in a semi-clutching mode, to avoid the accident of yarn breaking. Preferably, a broken yarn detection unit is also provided. The broken yarn detection unit is an electrical control broken yarn detection unit, including a photoelectric sensor. When the photoelectric sensor detects yarn breaking faults, the control unit controls the electromagnetic clutch 4024 to be electrified, thus cutting off the transmission line between driven gear 4022 and the clutch 4024.

The twisted yarns 17 are continuously reeled on the reel at the free end of the tension compensating rod 401. The twisted yarns 17 pass through the ceramic hole of the transverse yarn guide 9 and then are reeled on the surface of the twisting package 1. After the twisting is completed, the finished twisting package 11 falls onto the twisting package conveyor 8. The twisting packages are conveyed by the twisting package conveyor 8 and collected at the twisting package unloading unit 10. Thus, the direct twisting operation flow is completed.

Two-in-One Twisting Mode:

During two-in-one twisting, the inner yarn packages 15 are exported from the lower spindle tanks 512. At this time, the upper spindle tanks 513 are taken down. The lower spindle tanks 512 are internally inserted with two-in-one inner spindle rods 515. The inner yarn packages 15 pass through the ceramic hole on two-in-one spindle wing 516, insert into the top holes of the two-in-one inner spindle rods 515, and pass through the upper steel linings 5151 and lower steel linings 5152 in turn. The upper steel linings 5151 and lower steel linings 5152 are bullet shaped, generating a braking force on the internal yarns. The internal yarns possess a certain tension after passing through the upper steel linings 5151 and lower steel linings 5152. The internal yarns go out via two-in-one twisting yarn channels 5032 of the yarn guide base components 503, and are thrown out via the yarn outlets 504. Due to the rotation of yarn storage disc 505 and twisting disc 506, the external yarns 13 form a certain wrap angle on the outer circle face of the yarn storage disc 505, and then form a ballooning 14 close to the outer circular arc face of the bottom of the twisting disc 506. The yarn guide unit 6 is positioned above the ballooning 13. The external yarns 13 pass through the ceramic hole of the yarn guide unit 6 on the extension line of the axis of the hollow spindle rod 502. The yarn guide unit 6 adjusts the height position according to the ballooning form. After passing through the yarn guide unit 6, the yarns are changed into two-in-one twisted yarns. The twisted yarns pass through the overfeeding unit 4, enter the transverse yarn guide 9 and the reeling unit 3, and then are reeled on the surface of the twisting package 11. After the twisting is completed, the finished twisting package 11 falls onto the twisting package conveyor 8. Thus, the two-in-one twisting operation flow is completed. In the two-in-one twisting mode, accessories such as the outer yarn pipes 12, the nozzle 7, the upper spindle tanks 513 and the inner yarn tensioners 514 are not needed. By taking down the upper spindle tanks 513 and inserting the two-in-one inner spindle rods 515, the present invention can be switched to the two-in-one twisting mode.

The above embodiments are merely some preferred technical solutions of the present invention, and cannot be regarded as limits to the present invention. The embodiments and the technical features of the embodiments in the present invention can be randomly combined if there is no conflict. The protective scope of the present invention should be subject to the technical solution of the Claims, including the equivalent replacement solutions of the technical features in the technical solution of the Claims. The equivalent replacements and modifications on this basis should also fall within the protective scope of the present invention.

What is claimed is:

1. A carpet yarn twisting machine, comprising a machine frame (18), a creel unit (1), an electric spindle unit (5), an overfeeding unit (4) and a reeling unit (3), wherein, in the electric spindle unit (5), a hollow spindle rod (502) is fixedly connected with a motor (501), the motor (501) drives the hollow spindle rod (502) to rotate, a twisting disc (506) and a yarn storage disc (505) are fixedly connected with the hollow spindle rod (502) and rotate along with the hollow spindle rod (502), the yarn storage disc (505) is provided with yarn outlets (504), which communicate with inner yarn channels of the hollow spindle rod (502), spindle tanks for accommodating inner yarn packages (15) are provided with spindle rod bearings (509), the hollow spindle rod (502) is rotatably connected to the spindle rod bearings (509), and the spindle tanks are immobile, a liftable yarn guide unit (6) is disposed at a top of each one of the spindle tanks, the yarn guide unit (6) is internally provided with a first suspending arm structure, a base of the first suspending arm structure vertically slides along the machine frame, a first ceramic ring through which yarns pass is disposed at a free end of the fir suspending arm structure, an axis of the first ceramic ring is superimposed with an axis of the hollow spindle rod (502), in the overfeeding unit (4), driving overfeeding rollers (402) and driven overfeeding rollers (403) are arranged with an interval therebetween;

the driven overfeeding rollers (403) are inclined with respect to an axis of the driving overfeeding rollers (402);

the driving overfeeding rollers (402) are connected with a driving unit through a transmission mechanism;

and a linear speed of surfaces of the driving overfeeding rollers (402) is higher than that of surfaces of reeling rollers (302) in the reeling unit (3), in each one of the driving overfeeding rollers (402), a driving gear (4021) is in an engaged connection with a driven gear (4022), while the driven gear (4022) is connected with a first shaft (4026) through a bearing (4028), the first shaft (4026) is fixedly connected with a roller body (4027), the first shaft (4026) is connected with a bracket (4029) through the bearing, a clutch disc (4023) is installed on the first shaft (4026) in an axial sliding way, the clutch disc (4023) is capable of driving the first shaft (4026) to rotate, an end face of the clutch disc (4023) and an end face of the driven gear (4022) are in a separable transmission connection, the first shaft is provided with a spring (4025) for compressing the clutch disc (4023) toward the driven gear (4022) and is also fixedly provided with an electromagnetic clutch (4024), and the electromagnetic clutch (4024) is internally provided with a coil (4030) for absorbing the clutch disc (4023) and overcoming the spring force of the spring (4025) and separating the clutch (4023) from the driven gear (4022), a tension unit (2) for tension control is also provided, the tension unit (2) is disposed on the creel unit (1), the tension unit (2) comprises driven tension rollers (201) and driving tension rollers (202) of which outer walls contact one another, the driven tension rollers (201) are fixedly installed, the driving tension rollers (202) are connected with tension air cylinders (203) through fork-shaped tension brackets (205), the tension air cylinders (203) communicate with air pipes (207), and each one of the air pipes (207) is provided with an electromagnetic proportioning valve (208) and an air pressure sensor (209), or the tension unit (2) is disposed on the machine frame, a tension roller or a yarn guide wheel (210) is fixedly connected with one end of a tension rod (218), the tension rod (218) is supported on a fixed tension rod bearing (211), the other end of the tension rod (218) extends into a sealed housing (212), a portion, in the sealed housing (212), of the tension rod (218) is provided with tension rod blades (213), the sealed housing (212) is internally filled in with damping medium (214), the tension rod (218) and the sealed housing (212) are in a sliding connection, a tension motor (217) and a nut sleeve (216) are in a fixed connection, the nut sleeve (216) and the sealed housing (212) are in a threaded connection, by rotating the nut sleeve (216), an axial position of the sealed housing (212) is capable of being adjusted, and a depth of the tension rod blades (213) in the damping medium (214) is capable of being adjusted.

2. The carpet yarn twisting machine according to claim 1, wherein, the hollow spindle rod (502) is provided with a step shaft at a top of the hollow spindle rod, at least two spindle rod bearings (509) are sleeved on the step shaft; bearing bases (510) are respectively sleeved on corresponding spindle rod bearings (509), lower spindle tanks (512) among the spindle tanks are sleeved with the bearing bases (510), spindle tank inner rods (511), which are fixedly connected with the lower spindle tanks (512) and are capable being replaced, are also provided, each one of the spindle tank inner rods (511) comprises a two-for-one twisting inner spindle rod (515) for two-in-one twisting, the bottom of the two-for-one twisting inner spindle rod (515) is sleeved with each corresponding one of the lower spindle tanks (512), the top of the two-for-one twisting inner spindle rod (515) is provided with a two-for-one twisting spindle wing (516), the two-for-one twisting spindle wing (516) is a second suspending arm structure, the second suspending arm structure is provided with a second ceramic ring through which inner yarns pass at a free end of the suspending arm, the two-for-one twisting inner spindle rod (515) is formed with an axial through-hole in a middle, the through-hole communicates with the yarn channels with upward tails in a vertical direction in a yarn guide base component (503), a second shaft is disposed in a center of the through-hole of the two-for-one twisting inner spindle rod (515), an upper steel lining (5151) and a lower steel lining (5152) are also disposed in the through-hole, the second shaft in the center of the through-hole passes through the upper steel lining (5151) and the lower steel lining (5152), or, a two-in-one tensioner is disposed in the through-hole of the two-in-one twisting inner spindle rod (515), wherein a structure of the steel ball type two-in-one tensioner is that: the two-in-one twisting inner spindle rod (515) is internally provided with a sliding inner spindle rod (5155), the sliding inner spindle rod (5155) is sleeved with an inner spindle rod base (5157) in a sealing and sliding way, an inner spindle rod spring (5156) is disposed between the inner spindle rod base (5157) and the sliding inner spindle rod (5155), the sliding inner spindle rod (5155) is provided with a spindle rod ceramic ring base (5154) at a top of the sliding inner spindle rod, the spindle rod ceramic ring base (5154) has a swelling cavity inside, a third ceramic ring with a tapered upper opening is disposed at a bottom of the cavity, and the spindle rod ceramic ring base (5154) is internally provided with a steel ball (5153).

3. The carpet yarn twisting machine according to claim 1, wherein, a twisting package conveyor (8) is disposed below the reeling unit (3), the twisting package conveyor (8) is a belt conveyor which penetrates through a whole twisting station, the twisting package conveyor (8) is provided with a twisting package unloading unit (10) at a tail of the twisting package conveyor, and the twisting package unloading unit (10) is provided with an inclined slideway for conveying twisting packages.

4. The carpet yarn twisting machine according to claim 1, wherein, in the reeling unit (3), a reeling bracket (301) is a quadrilateral mechanism capable of swinging up and down, the reeling bracket (301) is used for installing twisting packages (11), a reeling roller (302) is disposed below each one of the twisting packages (11), outer walls of the reeling rollers (302) contact outer walls of the twisting packages (11), and a transverse yarn guider (9) is disposed in a yarn coming direction of the reeling rollers (302).

5. The carpet yarn twisting machine according to claim 4, wherein, each one of the reeling rollers (302) is internally provided with a clutch device with a specific structure that:

a reeling roller inner barrel (3028) is fixedly connected with a transmission shaft (3021), a middle transmission member (3024) is supported on the reeling roller inner barrel (3028) through two transmission roller bearings (3023), a reeling roller outer barrel (3020) is fixedly connected with the middle transmission member (3024), a friction disc (3026) is disposed on one side of the middle transmission member (3024), the friction disc (3026) and the reeling roller outer barrel (3020) are connected in a way of being capable of moving with respect each other along an axial direction and being incapable of rotating with respect to each other, the friction disc (3026) is made of ferromagnet, the middle transmission member (3024) is internally provided with a reeling roller electromagnetic coil (3029), the reeling roller inner barrel (3028) is provided with a convex ring (3030) on the other side of the friction disc (3026), the convex ring is provided with a friction sheet (3027) which is matched with the friction disc (3026) to form frictional transmission, and a spring (3025) is disposed between the middle transmission member (3024) and the friction disc (3026).

6. The carpet yarn twisting machine according to claim 4, wherein, one end of a tension compensating rod (401) is hinged with the machine frame while the other end is provided with a yarn wheel, twisted yarns going out of the overfeeding unit (4) are coiled on the yarn wheel and then enter the reeling unit (3) via the transverse yarn guider (9) such that the tension compensating rod (401) swings to vertical direction and horizontal direction alternatively according to a tension.

7. The carpet yarn twisting machine according to claim 5, wherein, one end of a tension compensating rod (401) is hinged with the machine frame while the other end is provided with a yarn wheel, twisted yarns going out of the overfeeding unit (4) are coiled on the yarn wheel and then enter the reeling unit (3) via the transverse yarn guider (9) such that the tension compensating rod (401) swings to vertical direction and horizontal direction alternatively according to a tension.

* * * * *